United States Patent [19]

Livick

[11] 4,192,508

[45] Mar. 11, 1980

[54] MAGNETIC BALL GAME

[76] Inventor: Lester R. Livick, 15106 Beatty St., San Leandro, Calif. 94579

[21] Appl. No.: 902,438

[22] Filed: May 3, 1978

[51] Int. Cl.[2] ..... A63F 9/14

[52] U.S. Cl. ..... 273/118 A; 273/1 M; 273/86 B; 46/240

[58] Field of Search ..... 273/1 M, 86 B, 186 A, 273/118 A, 119 A; 46/238, 239, 240

[56] References Cited

U.S. PATENT DOCUMENTS

| | | | |
|---|---|---|---|
| 1,858,020 | 5/1932 | Linke | 273/86 B |
| 2,956,807 | 10/1960 | Luchsinger | 273/1 M |
| 2,998,973 | 9/1961 | Schaper | 273/86 B X |
| 3,113,782 | 12/1963 | Guier | 273/186 A |
| 4,160,548 | 7/1979 | Breslow et al. | 46/240 X |

FOREIGN PATENT DOCUMENTS

| | | | |
|---|---|---|---|
| 623033 | 7/1961 | Canada | 273/118 A |
| 14764 | of 1894 | United Kingdom | 273/1 M |

*Primary Examiner*—George J. Marlo
*Attorney, Agent, or Firm*—William R. Piper

[57] ABSTRACT

A game of skill in which one or more runways for ball bearings are provided and are covered by a transparent shield and the object of the game is for the player to move the carriage to cause the magnet to attract a ball bearing and move it along the runway as rapidly as possible. The runway is a groove which is open at each end of the shield. In order to place the ball bearing in the groove, the player moves the carriage, which has a ball bearing magnetically attached thereto, toward the open end of the groove. As the ball bearing is moved into the groove, a beveled edge of the shield causes the bearing to be pried loose from the carriage, and drop into the groove. The skill factor of the game can be changed by moving the magnet in the carriage toward or away from the shield and thereby vary the magnetic attraction between the ball bearing and the magnet.

3 Claims, 4 Drawing Figures

FIG-1-
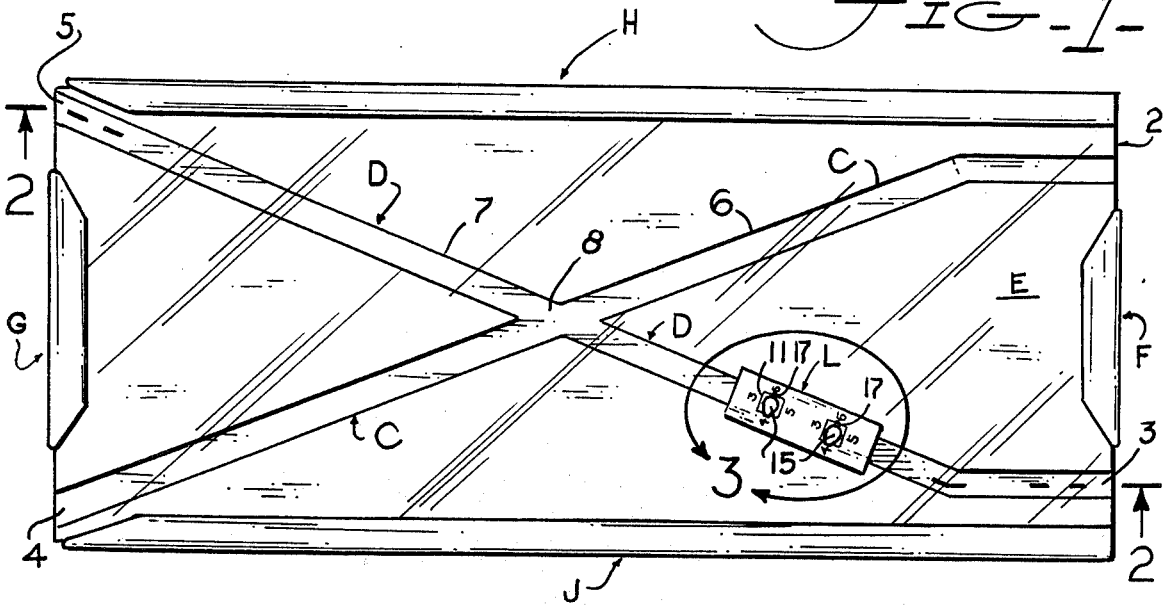
FIG-2-
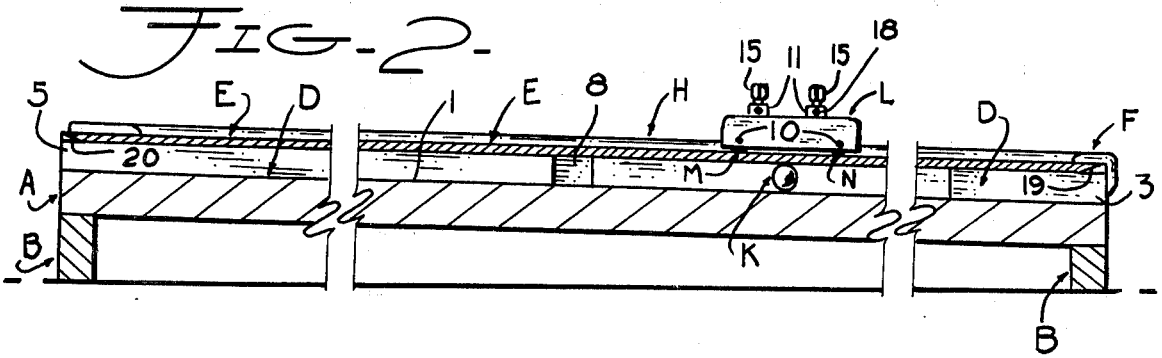
FIG-4-
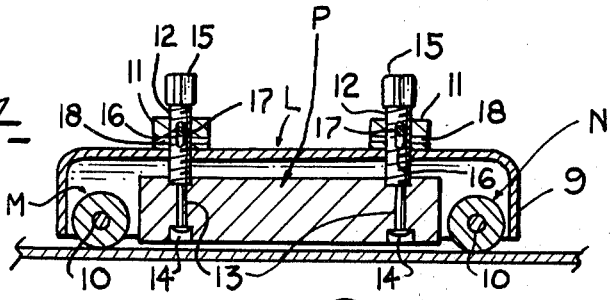
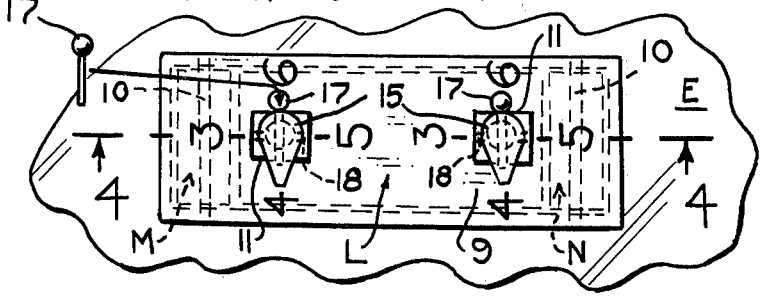
FIG-3-

MAGNETIC BALL GAME

SUMMARY OF THE INVENTION

An object of my invention is to provide a game of skill in which the skill factor can be changed according to the age of the child playing the game. The game is primarily designed to be played by children between the ages of three to six years old. The magnet in the carriage can be moved closest to the shield for the three year old player and fartherest away for the six year old, thus varying the magnetic attraction between the magnet and the ball bearing to be greatest for the three year old player and the least for the six year old player.

A further object of my invention is to provide a game of the type described in which the edges of the shield, positioned directly above the entrances to the ball bearing runways, have a bevelled under surface forming a knife-shaped edge. This permits the player to place the ball bearing in direct contact with the exposed undersurface of the magnet and then when the player moves the carriage into a position at the entrance of the runway, any further movement of the carriage along the runway will cause the knife edge on the shield to direct the ball bearing into the runway and to remove it from direct contact with the magnet.

BRIEF DESCRIPTION OF THE DRAWING

FIG. 1 is a top plan view of the game.

FIG. 2 is a longitudinal vertical section through the game and is taken along the line 2—2 of FIG. 1.

FIG. 3 is an enlarged top plan view of the magnet carrying carriage of the circled portion 3 in FIG. 1.

FIG. 4 is a vertical longitudinal section through the carriage and is taken along the line 4—4 of FIG. 3.

DESCRIPTION OF THE PREFERRED EMBODIMENT

In carrying out my invention, I provide a rectangular game board A which is supported by legs B, so that the playing surface of the game board is on a slight incline, see FIG. 2. The upper surface 1 of the game board has a pair of elongated grooves C and D that extend from the entrance ends 2 and 3 of the grooves, respectively, to the exit ends 4 and 5. The inclined portion 6 of the groove C, crosses the inclined portion 7 of the groove D, and the intersection 8 of the two grooves is approximately at the center of the playing surface 1.

A transparent cover plate E of glass or plastic of the same size and shape as the game board A, overlies the board and rests on the upper surface 1 of the board. The game board A has angle-shaped end flanges F and G, see FIGS. 1 and 2 and these flanges are secured to the ends of the board and have their upper portions bearing against the top surface of the transparent cover E, note the end view of the flange F in FIG. 2. In addition, side flanges H and J, are secured to the side edges of the game board and have portions contacting the upper surface of the transparent cover E.

The grooves C and D are deep enough to permit one or more ball bearings K, see FIG. 2, to travel along these grooves which constitute runways along which the ball bearings are free to travel. I provide novel means for moving the ball bearing along the runways. In FIGS. 3 and 4, I show a carriage L whose housing 9 is rectangular in shape and has four side walls. The bottom of the housing is open and rollers M and N are rotatably supported by axles 10 which in turn are supported by the side walls of the housing 9. The rollers support the open bottom of the housing 9, so that the lower edge of the housing will be disposed a slight distance above the upper surface of the transparent cover E, see FIG. 4.

The carriage L, encloses a magnet P, see FIG. 4, and I provide novel means for supporting the magnet and for adjusting the distance between the undersurface of the magnet and the upper surface of the transparent cover E. It is well known that the closer a magnet is disposed to a metal object, such as the ball beaing K, the greater the magnetic attraction between the two. I make use of this magnetic principle in making the game more difficult to play according to the ages of the persons playing the game.

Referring to FIG. 4, it will be seen that the magnet P, is supported at two places and since these two supports are identical to each other, a detailed description of one of the supports will suffice for both and like reference characters will be applied to similar parts. The top of the housing 9 for the carriage L, has an integral boss 11 that is substantially square in horizontal cross section. The boss 11 has a vertical threaded bore therein which receives a threaded shank 12. The lower portion 13 of the shank 11 is not threaded and is of a reduced diameter and is received in a vertical bore in the magnet P. The lower portion 13 has a head 14 received in a recess in the bottom of the magnet for supporting the magnet.

The top of the threaded shank 12 has an integral knob 15 that is shaped like a pointer, see FIG. 3. The portion of the threaded shank 12 that is received in the threaded bore of the boss 11, is provided with a slot 16 and a locking pin 17 extends through the slot and is removably received in radially extending openings 18 in the boss. It should be noted from FIG. 4, that the top of the housing 9 has the numerals "3", "4", "5", and "6", associated with the four sides of the bosses 11. These numerals refer to the ages of the children playing the game. For example, a four year old player would rotate the knobs 15 until their pointed ends would point to the numeral "4" on the housing. The locking pin 17 would then be inserted in the opening 18 in the boss 11 associated with the numeral "4", and the pin would also extend through the slot 16 in the screw shank 12 and prevent it from being rotated.

The threads on the threaded shanks 12 are so pitched that as the pointed ends of the knobs 15 are rotated from numeral "3" on the housing 9 to the numeral "6", the threaded shanks would raise the magnet P, in the housing to increase the distance between the bottom of the magnet and the top of the transparent cover E, and thus decrease the magnetic attraction between the magnet and the ball bearing K. In other words, since the magnet P would be closer to the ball bearing K for a three year old playing the game than a six year old, the increased magnetic attraction between the magnet and the ball bearing for the three year old would make it easier for him to play the game when playing against a six year old where the magnet would be spaced further away from the ball beaing resulting in a less magnetic attraction between the two.

The purpose of the game is to move the carriage L, as quickly along the desired groove C or D, as possible and attract the ball bearing K, in the groove to move the ball bearing along the desired groove. If the carriage L is moved too rapidly, the ball bearing will not be attracted and the player will have to back up his carriage to again move the ball bearing.

In the actual playing of the game, the player can remove the carriage L from the transparent cover E and turn the carriage to expose the magnet whereupon he can place one or more ball bearings on the magnet. He then removes the locking pins 17 from the two bosses 11 and rotates the knobs 15 so that their pointed ends will indicate the numeral representing his age. For example, FIG. 4 shows the knobs 15 pointing to the numeral "4". This will move the magnet P, in the housing 9 so that when the carriage L is again placed on the transparent cover E, the undersurface of the magnet will be positioned farther away from the outer surface of the cover and therefore the magnet will have a less magnetic attraction for the ball bearing K, in the grooves C and D, than if the knobs 15 had pointed to the numeral "3". I do not wish to be confined to the numerals "3" to "6", inclusive, representing corresponding ages for the children playing the game because these numbers merely represent degrees of difficulties in playing the game.

FIG. 2 shows the ends of the transparent cover E with a bevelled undercut portion 19, overlying the entrance 3 to the groove D, in the gameboard A, and with a bevelled undercut portion 20, overlying the exit 5 to the same groove. There is also bevelled undercut portions on the two ends of the transparent cover E, that overlie the entrance end 2 and the exit end 4 of the groove C.

The player moves the carriage L, with its one or more ball bearing K contacting the undersurface of the magnet P, toward the groove entrance 3, in FIG. 1, and the ball bearing will contact the under bevelled portion 19 and be pried loose from the magnet and will drop into the groove D. From this point on, the object of the game is for the player to move the carriage L, as rapidly as possible, along the groove D, and trust that the magnetic attraction between the magnet P and the ball bearing K, will be strong enough to pull the ball bearing along the groove to the exit end. If the carriage is moved too fast or if the player causes the carriage L to stray laterally too far from the groove, the magnet will cease to attract the ball bearing and this will necessitate the player to move the carriage back over the ball bearing to again magnetically attract it. A loss of playing time results. The one moving the ball bearing the fastest from the entrance to the exit end of the groove will be the winner.

It is possible for the player to move the ball bearing K in the groove D, up to the intersection 8, between the two grooves D and C, and then for the player to continue to move the carriage along the groove C to the exit end 4, rather than move the ball bearing through the remaining portion of the groove D to the exit end 5. In this way, the playing of the game may be made more difficult. Although I have shown only two grooves C and D, in the gameboard A, and each has an inclined portion 6 for the groove C and 7, for the groove D, it is obvious that any number of grooves may be used and they may be of different shapes other than that shown.

I claim:

1. A device of the type described, comprising:

(a) a rectangular board having a flat upper surface with guide grooves therein large enough in width and depth to permit a ball bearing to move along a desired groove, said grooves extending from one end of the board to the other end, the grooves being open at each board end;

(b) a transparent flat cover plate covering the grooves and the flat upper surface of the game board;

(c) a carriage movably supported by the upper surface of the cover and housing a magnet; and (d) means for positioning the magnet in said carriage so that the undersurface of said magnet will be disposed a predetermined distance above the upper surface of the cover, said cover separating the magnet from the ball bearing and the magnet exerting sufficient magnetic force on said ball bearing to move it along the groove in which the ball bearing is disposed as the carriage is moved.

2. The combination as set forth in clam 1: and in which (a) the means for positioning the magnet in the carriage includes a pair of threaded shanks received in threaded bores in the carriage wall, the lower ends of said shanks being anchored in the magnet so as the shanks are rotated they will alter the position of the magnet so that when the carriage is placed on the cover the magnet will be disposed a predetermined distance above the cover;

(b) a knob mounted on each threaded shank and having a pointed portion that will rotate through 360° as the threaded shank makes one complete rotation; and (c) said carriage having numerals angularly arranged around each screw shank at which the pointed portions can point for altering the position of said magnet with respect to said carriage.

3. The combination as set forth in claim 1: and in which (a) the ends of the cover overlying the open entrance and open exit ends of the grooves are provided with undercut bevelled portions for guiding the ball bearing into the open end of the adjacent groove as the carriage is moved onto the upper surface of the cover at the open entrance of the groove, thereby separating the ball bearing from contacting the magnet and for permitting the ball bearing to again come into contact with the magnet as the carriage is moved off from the cover at the open exit end of the groove.

* * * * *